US006006813A

United States Patent [19]

Jelic

[11] Patent Number: 6,006,813

[45] **Date of Patent: *Dec. 28, 1999**

[54] WINDOW HAVING A BLIND BETWEEN TWO PANES OF GLASS

[75] Inventor: Ralph Jelic, Valencia, Pa.

[73] Assignee: OEM Shades, Inc., Ford City, Pa.

[ * ] Notice: This patent is subject to a terminal disclaimer.

[21] Appl. No.: 08/813,536

[22] Filed: Mar. 7, 1997

Related U.S. Application Data

[63] Continuation of application No. 08/555,133, Nov. 8, 1995, Pat. No. 5,611,381.

[51] Int. Cl.[6] ..... E06B 9/264

[52] U.S. Cl. ..... 160/107; 52/786.11; 160/168.1

[58] Field of Search ..... 160/107, 178.1, 160/168.1, 176.1; 52/786.11

[56] References Cited

U.S. PATENT DOCUMENTS

| | | | |
|---|---|---|---|
| 1,957,272 | 5/1934 | Kuyper | 160/168.1 |
| 2,545,631 | 3/1951 | Ribley | 160/176.1 |
| 2,976,583 | 3/1961 | McCarthy | 52/786.11 |
| 3,342,243 | 9/1967 | Salter | 160/107 |
| 3,703,920 | 11/1972 | Debs | 160/176.1 |
| 3,719,221 | 3/1973 | Hanson | 160/107 |
| 3,795,267 | 3/1974 | Debs | 160/107 |
| 4,274,469 | 6/1981 | Kuyper et al. | 160/107 |
| 4,456,049 | 6/1984 | Vecchiarelli | 160/107 |
| 4,643,238 | 2/1987 | Tachikawa et al. | 160/168.1 |
| 4,664,169 | 5/1987 | Osaka et al. | 160/107 |
| 4,687,040 | 8/1987 | Ball | 160/107 |
| 4,913,213 | 4/1990 | Schnelker | 160/107 |
| 5,000,242 | 3/1991 | Coddens | 160/107 |
| 5,180,130 | 1/1993 | McMichael | 160/902 |
| 5,226,466 | 7/1993 | Coddens | 52/202 |
| 5,379,825 | 1/1995 | Jelic | 160/107 |

*Primary Examiner*—Michael Safavi
*Attorney, Agent, or Firm*—Buchanan Ingersoll, P.C.

[57] ABSTRACT

A double pane window has a blind between the window panes. The interior window pane is in a housing that can be removed from the window frame. A cord guide is provided in the top edge of the housing. The cord guide has a lift cord slot and a tilt cord slot. The blind has at least one lift cord which passes through the lift cord slot and at least one tilt cord which passes through the tilt cord slot. The blind can be raised, lowered and tilted while maintaining a seal between the window frame and the window panes.

2 Claims, 6 Drawing Sheets

WINDOW HAVING A BLIND BETWEEN TWO PANES OF GLASS

This application is a continuation of application Ser. No. 08/555,133 filed Nov. 8, 1995 now U.S. Pat. No. 5,611,381.

BACKGROUND OF THE INVENTION

1. Field of the Invention

The present invention relates to a double glazed window having a blind between double panes of glass.

2. Description of the Prior Art

It is well known in the art that double panes of glass in a window provides better insulation than a single pane of glass. It is also known in the art to provide venetian type blinds or pleated shades between two panes of glass. A pleated blind between window panes is disclosed in the U.S. Pat. No. 4,913,213 to Schnelker. A venetian or slat blind between panes of glass is disclosed in the U.S. Pat. Nos. 4,687,040; 4,664,169 and 5,379,825. Control means for lifting, lowering and tilting the blind from one side of the window must be provided while maintaining the window seal. The art has provided cords and cables, sometimes driven by a motor or gear system, as the control means. The most popular systems route the cord through an aperture drilled through the interior pane of glass.

U.S. Pat. No. 4,687,040 to Ball discloses a device for adjusting the tilt angle of slats of a slat blind positioned between the panes of glass. The device includes a hole in one pane of glass and a flexible cable passing through the hole. The cable is connected to a rectangular member which controls the rotation of the slats. When the cable is turned by external torque, the slats are tilted.

U.S. Pat. No. 4,913,213 discloses a pleated blind between double window panes and blind control means for raising and lowering the blind. One embodiment is comprised of an aperture in one pane of glass and a bolt with a center hole mounted in the aperture. An actuator cord passes through the bolt hole and further up and over a screen, if desired, thereby providing an external control mechanism.

The prior art has also developed more complicated control means that utilize cables and gear systems that pass through the window frame rather that the glass. U.S. Pat. No. 4,664,169 to Osaka et al. discloses a device for tilting slats of a venetian blind between double panes of glass. The device uses electrical power driving means to move piezoelectric bimorph device in a horizontal plane. The piezoelectric bimorph device is mounted to a block having a threaded bore. The piezoelectric bimorph device mechanically moves an elongated V-shaped beam under two cross arms which control the rotation of the slats. When the beam is moved, the cross arms are tilted, thereby rotating the slats.

The complicated systems that require control means to be mounted in or routed through the window frame are relatively expensive to manufacture. Furthermore, in many of these systems gears and motors wear and then slip or fail. Many of these control devices require a headrail which is too wide to fit between the panes of those windows whose panes are not more than ¾ inches apart. Hence, these systems have never achieved the popularity of through the glass systems. Those systems which require apertures to be drilled or cut through the glass are disliked by manufacturers because breakage of the glass during drilling and assembly is common.

The problems of the prior art systems discussed above are not present if the control means is a cord or cords routed between the edge of the interior glass panel and the window frame. In U.S. Pat. No. 4,913,213 Schnelker describes a pleated blind between window panes. In a second preferred embodiment the actuator cord is routed over the glass housing and any screen housing provided. An L-shaped guide having a single vertical and horizontal channel cut therein is fitted over the top edge of the glass housing. An actuator cord passes through the channel. A major problem with this system is that one cannot maintain a seal between the window frame and the edge of the glass housing. Another problem is that most blinds have four control cords, two lift cords and two tilt cords. If all four cords are routed through a single channel they tend to bind and interfere with one another.

SUMMARY OF THE INVENTION

The double pane window of the present invention has a blind positioned between two panes of glass. The blind is raised, lowered and tilted by control cords which pass between the window frame and the housing of the interior glass panel. A cord guide having two parallel horizontal channels is fitted into a slot cut in the edge of the housing of the interior glass panel. The lift cords are routed through one channel and the tilt cords are routed through the second and third channel. Because the top of the cord guide is even with the top edge of the housing a seal can be maintained between the window frame and the interior glass panel.

Other details, objects and advantages of the invention will become apparent as the following description of certain present preferred embodiments thereof proceeds. In the accompanying drawings I have shown certain present preferred embodiments of the invention.

DETAILED DESCRIPTION OF THE INVENTION

Figure 1:
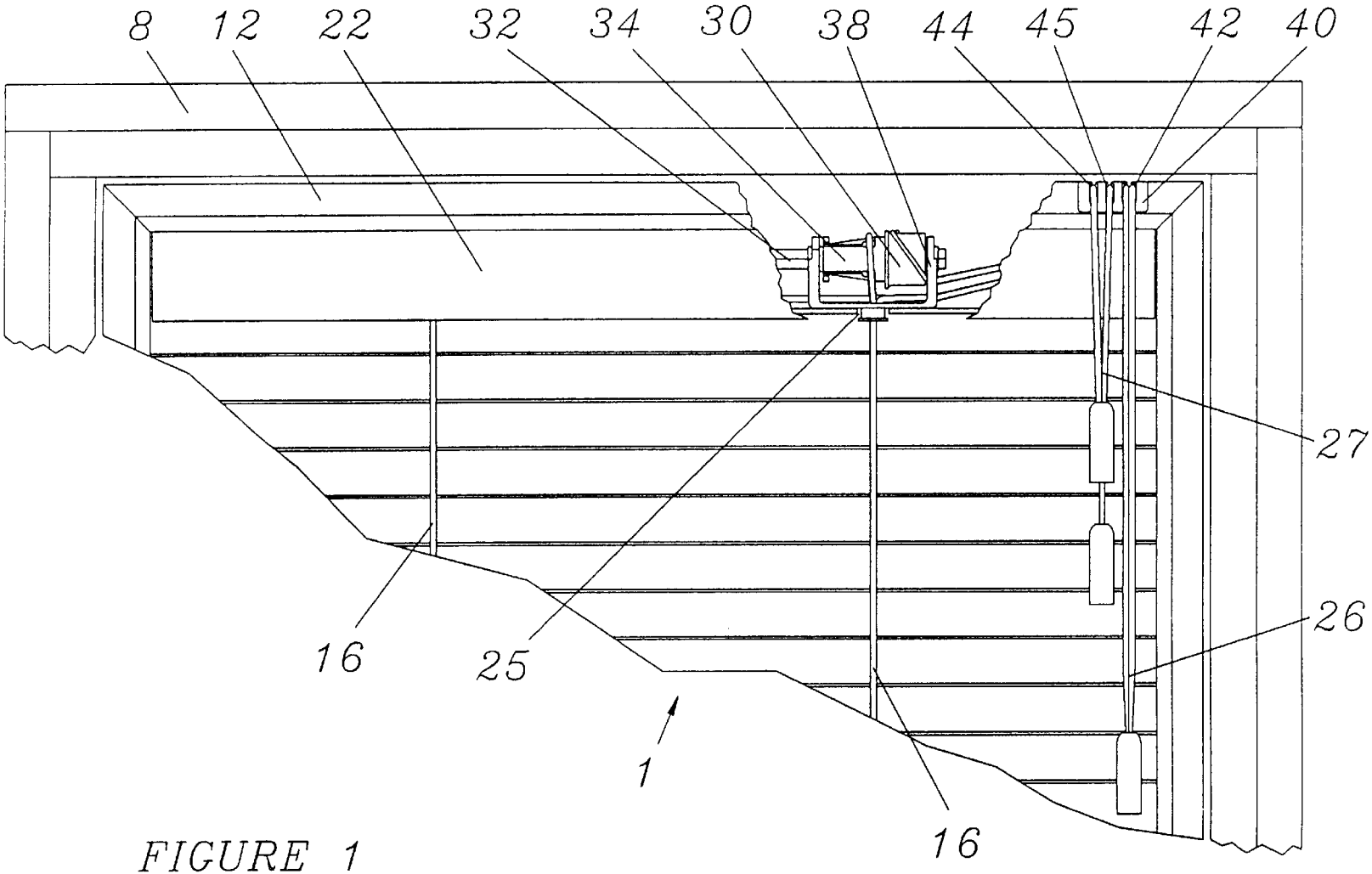
FIG. 1 is an front elevational view of a portion of a present preferred embodiment of my double pane window having a blind mounted between the panes.

As shown in FIGS. 1 through 4 and 7, a window blind 1 is positioned between an interior window panel 4 and an exterior pane of glass 6. The exterior pane of glass is permanently seated in a window frame 8 which typically is a wooden frame. The interior window panel 4 is a pane of glass 10 surrounded by a housing 12. That housing may be wood but usually is aluminum or vinyl. The interior panel is removably mounted to the window frame 8. A seal 11 is preferably provided between the housing 12 and window frame 8. This seal 11 may be placed adjacent the inside face of the housing 12 as shown or along the top 13 of the housing. If desired, the exterior window pane can also be removable and of similar construction to the interior window panel.

Figure 2:
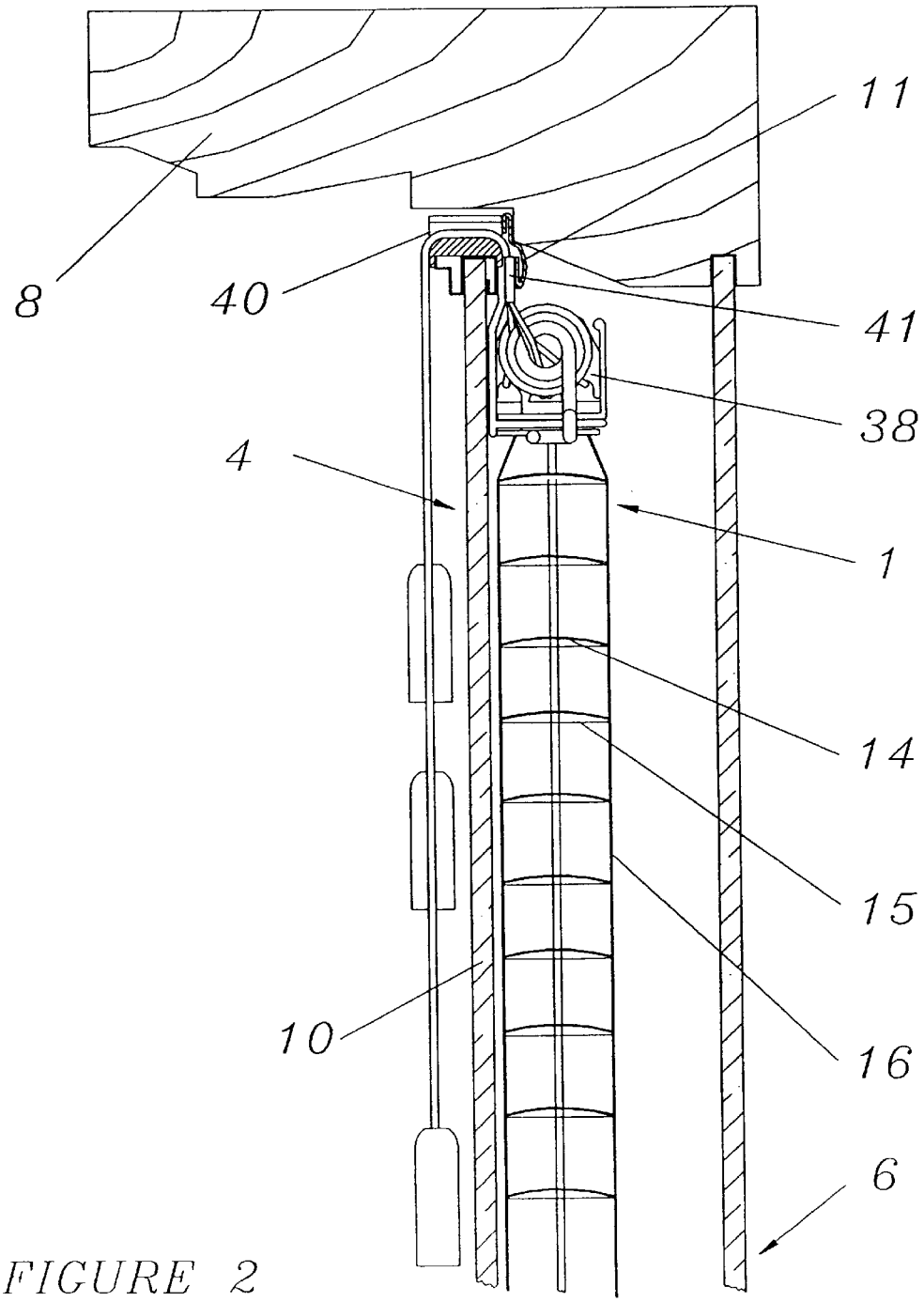
FIG. 2 is a side view partially in section of the window of FIG. 1.
Figure 3:
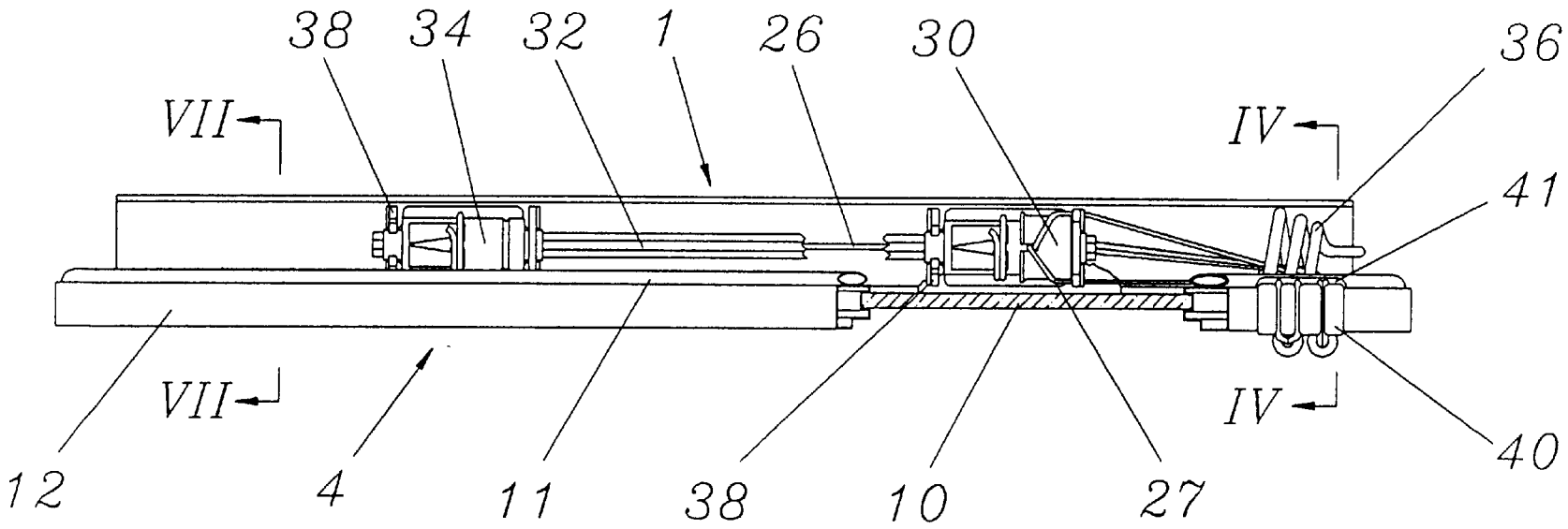
FIG. 3 is a top plan view of the interior window panel and attached blind showing the routing of the lift cords and the tilt cords.
Figure 7:
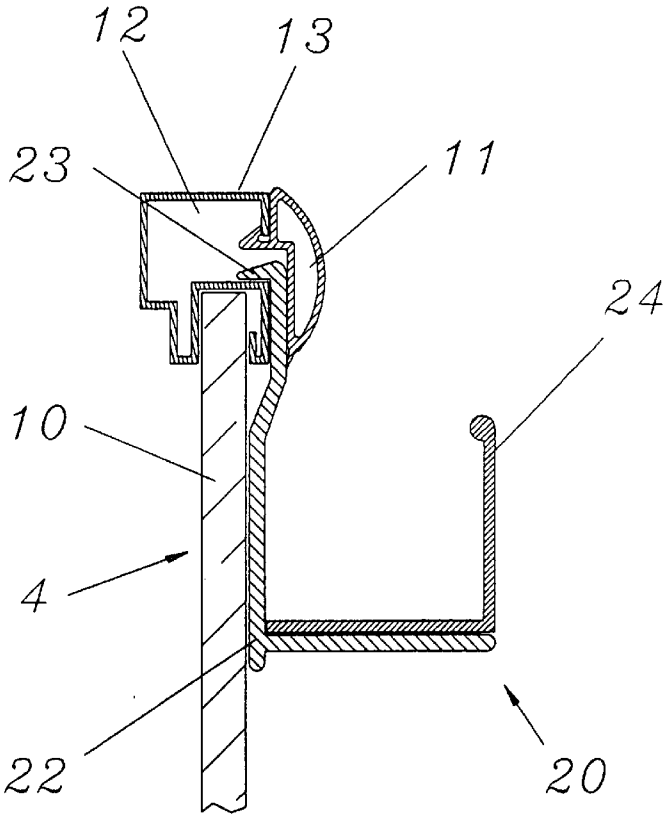
FIG. 7 is a cross-sectional view taken along the line VII—VII of FIG. 3.
Figure 4:
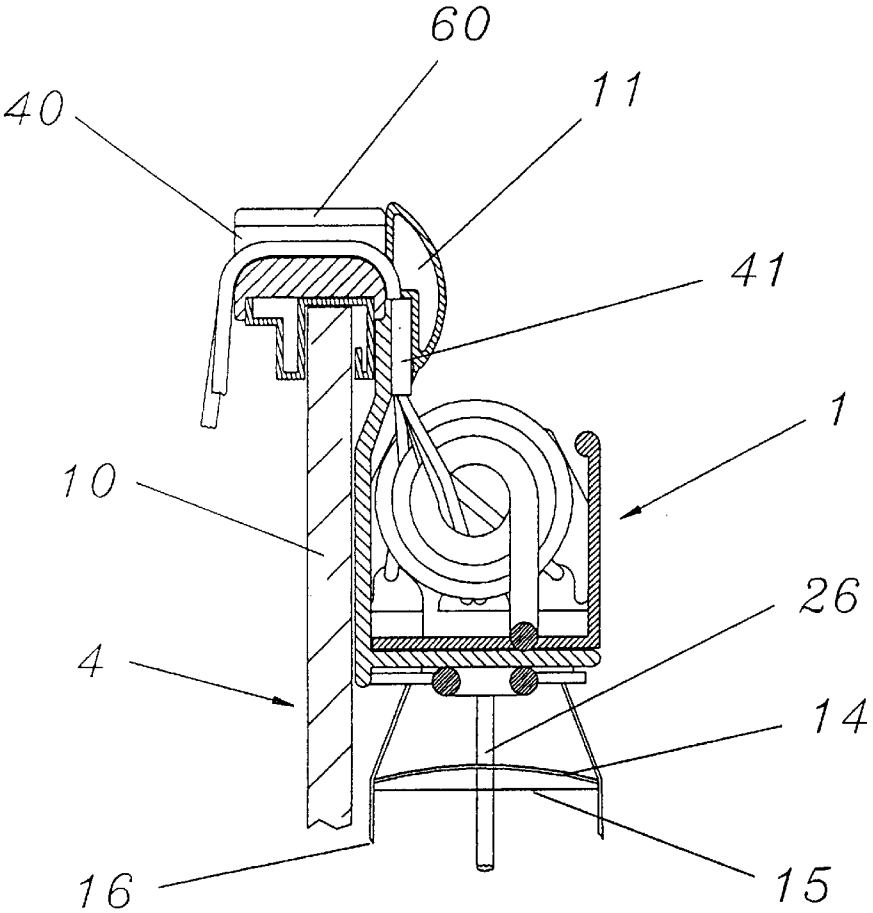
FIG. 4 is a cross-sectional end view taken along the line IV—IV of FIG. 3.

The blind 1 has a plurality of spaced parallel slats 14 which are typically made of aluminum. The slats rest on rungs 15 of ladders 16 that extend from the headrail. As shown most clearly in FIG. 7, the headrail 20 is of an elongated U-shape which has an L-shaped front portion 22, and a back portion 24. Each of the front portion 22 and back portion 24 formed of a bottom with an attached upright. The front portion 22 having a slot into which the bottom of the back portion 24 is fitted. The back portion 24 and L-shaped front portion 22 offer a slot 25 which receives the bottom portion of bracket 38 of the front portion as shown in FIG. 2. This type of construction permits the width of the headrail to be changed. The headrail 20 is usually made of aluminum. The headrail 20 is secured to the housing 12 of the interior panel of glass inserting the top portion 23 of the L-shaped front 22 into the rear opening of the housing 12 along with window seal 11. This is shown most clearly in FIG. 7.

A pair of lift cords 26 extend through the slats and the headrail to the exterior of the blind. At least one and preferably two tilt cords 27 extend from the headrail 20. The tilt cords 27 are wound around a tilt spool 30 within the headrail 20. The tilt spool is attached to coupling 34 which is also provided to connect the ladders to rod 32. Thus, when a user pulls one of the tilt cords, rod 32 will turn in a clockwise direction. When the other tilt cord is pulled rods 32 will rotate counterclockwise. Such movement will serve to open and close the blind 1. I prefer to provide a coil of wire or spring 36 having one end attached to the bottom surface of the L-shaped front portion 22 and an opposite end open to accept both the lift cords 26 and the tilt cords 27. The coils of the coil wire or spring 36 align the cords thru the headrail cord slot 41 and then over a cord guide 40.

The cord guide 40 is provided in a slot cut into the top 13 of the interior window panel housing 12. A lift cord channel 42 and two tilt cord channels 44 and 45 are provided in the cord guide 40. The cord guide 40 is sized and positioned so that the top of the cord guide is flush with the top of the housing 12. Furthermore, the cord guide is positioned so that the tilt cord channels are aligned with the coil wire or spring 36 and cord slot 41. When the cord guide is so positioned the tilt cords 27 operate very smoothly. The lift cord channel is also positioned so that the lift cords run directly to the aperture 47 in bracket 38. When the lift cords 26 are pulled or released, the blind 1 is lifted or lowered without any binding of the lift cords. Thus, the blind 1 can be tilted, lifted or lowered by external manipulation of the tilt cords 27 or the lift cords 26 while maintaining the window seal.

Figure 5:
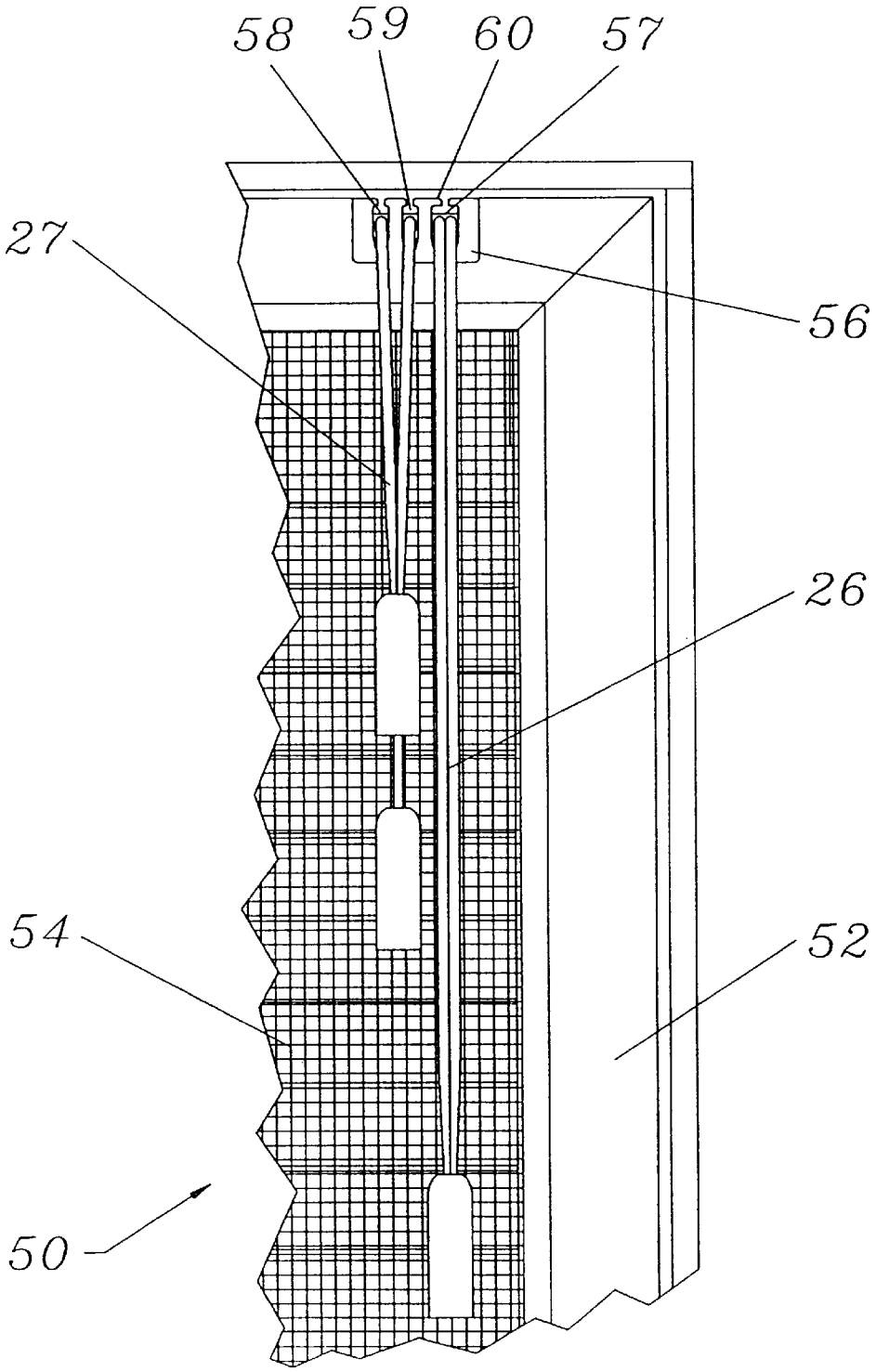
FIG. 5 is a front elevational view of a portion of a second present preferred embodiment of my double pane window having a blind mounted between the panes.
Figure 6:
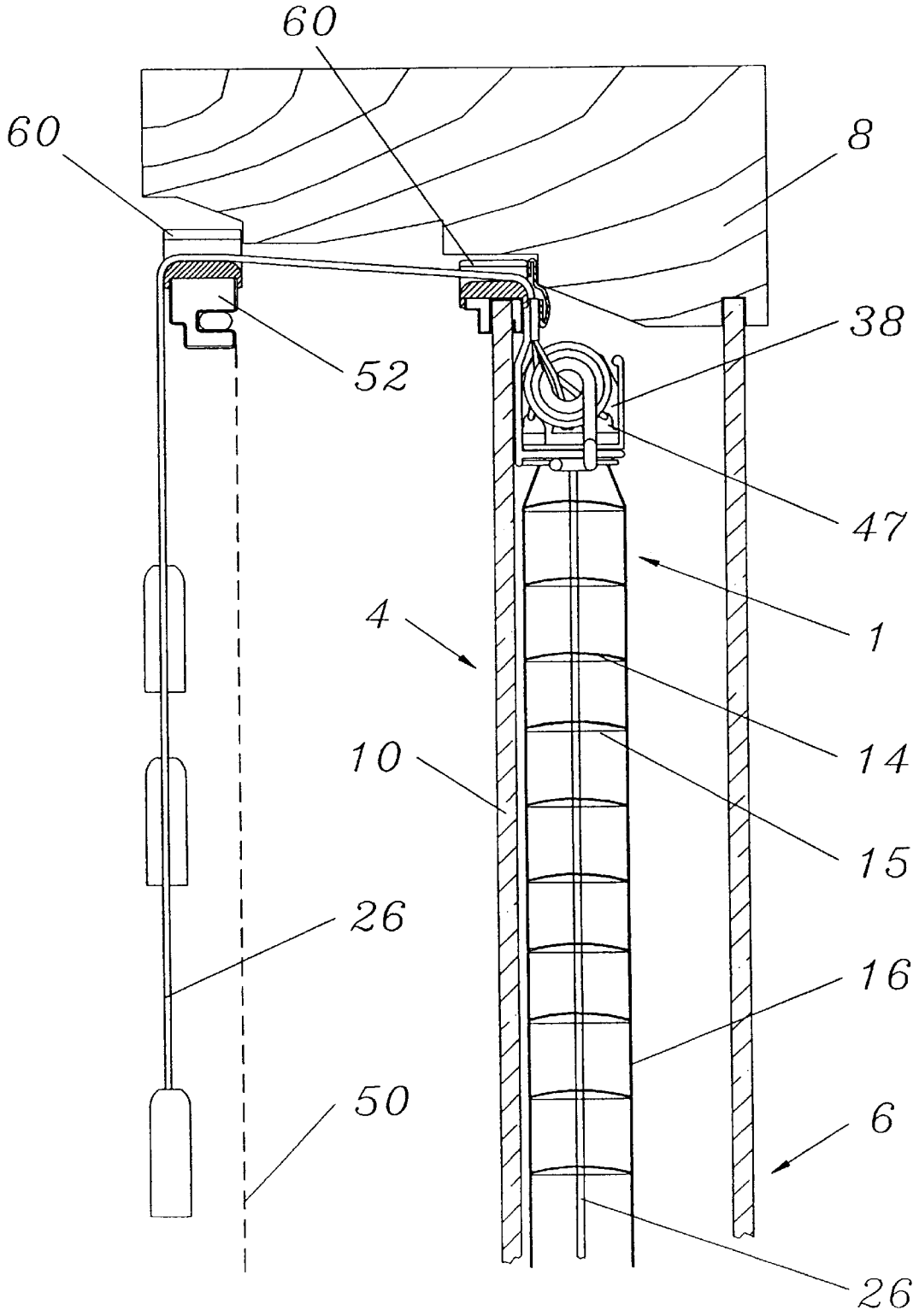
FIG. 6 is a side view partially in section of the embodiment shown in FIG. 5.

The second present preferred embodiment shown in FIGS. 5 and 6 is similar to the first embodiment but a screen 50 has been added. In these Figures the same reference numbers are used for like parts. The second embodiment has an exterior window pane 6 and interior window panel 4 in window frame 8. A blind 1 is placed between exterior window pane 6 and interior window panel 4. Screen 50 is comprised of a screen housing 52 to which screening material has been attached in the conventional manner. A second cord guide 56 is placed in a slot cut in screen housing 52. The second cord guide has a lift cord channel 57 and two tilt cord channels 58 and 59. The second cord guide 56 is positioned to be aligned with the first cord guide 40 when the screen 50 is in place. A keeper comprised of a pair of ledges 60 is positioned over the top of channels 57, 58 and 59 of the guide 56. The ledge prevent the cords from escaping from the cord channels during the raising and lowering or tilting of the blind.

In the preferred embodiments I have shown the cord guide to be at the top edge of the interior window panel. It is possible however to place the cord guide on either side of the interior window panel housing near the blind.

Although I have described and shown certain present preferred embodiments of my invention, it should be understood that the invention is not limited thereto but may be variously embodied within the scope of the following claims.

I claim:

1. A double pane window comprised of:

a. a window frame;

b. an exterior pane of glass attached to the window frame;

c. an interior window panel comprised of a pane of glass seated in a housing, the interior window panel being mounted within the window frame;

d. a cord guide attached to the housing, the cord guide having at least one cord slot; and e. a blind positioned between the exterior pane of glass and the interior window panel, the blind having at least one of a lift cord and a tilt cord which passes through the cord slot and a headrail, the headrail having an elongated L-shaped back portion containing a bottom and attached upright and an elongated L-shaped front portion the front portion having a slot into which the bottom is fitted.

2. A double pane window comprised of:

a. a window frame;

b. an exterior pane of glass attached to the window frame;

c. an interior window panel comprised of a pane of glass seated in a housing, the interior window panel being mounted within the window frame;

d. a cord guide attached to the housing, the cord guide having at least one cord slot; and e. a blind positioned between the exterior pane of glass and the interior window panel, the blind having at least one of a lift cord and a tilt cord which passes through the cord slot, a headrail and a coiled wire within the headrail which is sized and positioned to align the cords and reduce any restriction when the cords are routed over the housing.

* * * * *